US009121115B2

(12) United States Patent
Henssen et al.

(10) Patent No.: US 9,121,115 B2
(45) Date of Patent: Sep. 1, 2015

(54) YARN, A PROCESS FOR MAKING THE YARN, AND PRODUCTS CONTAINING THE YARN

(75) Inventors: Giovanni Joseph Ida Henssen, Echt (NL); Peto Verdaasdonk, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 0 days.

(21) Appl. No.: 14/116,404

(22) PCT Filed: May 10, 2012

(86) PCT No.: PCT/EP2012/058652

§ 371 (c)(1),
(2), (4) Date: Nov. 8, 2013

(87) PCT Pub. No.: WO2012/152871

PCT Pub. Date: Nov. 15, 2012

(65) Prior Publication Data

US 2014/0075646 A1 Mar. 20, 2014

(30) Foreign Application Priority Data

May 10, 2011 (EP) ..... 11165382

(51) Int. Cl.

| | |
|---|---|
| ***D02G 3/44*** | (2006.01) |
| ***D02G 3/04*** | (2006.01) |
| ***A41D 1/04*** | (2006.01) |
| ***A41D 19/015*** | (2006.01) |
| ***D03D 1/00*** | (2006.01) |
| ***D04B 1/24*** | (2006.01) |
| ***D04C 1/06*** | (2006.01) |

(52) U.S. Cl.

CPC *D02G 3/442* (2013.01); *A41D 1/04* (2013.01); *A41D 19/01505* (2013.01); *D02G 3/045* (2013.01); *D03D 1/0041* (2013.01); *D04B 1/24* (2013.01); *D04C 1/06* (2013.01); *Y10T 428/249921* (2015.04); *Y10T 428/2907* (2015.01)

(58) Field of Classification Search

CPC ..... D02G 3/02; D02G 3/045; D02G 3/22; D02G 3/442

USPC ..... 57/252, 255, 256

See application file for complete search history.

(56) References Cited

U.S. PATENT DOCUMENTS

| | | | | |
|---|---|---|---|---|
| 4,918,912 | A * | 4/1990 | Warner | 57/255 |
| 7,770,372 | B2 * | 8/2010 | Kolmes et al. | 57/256 |
| 2010/0050309 | A1 * | 3/2010 | Marissen et al. | 2/2.5 |
| 2011/0300366 | A1 * | 12/2011 | Henssen | 428/221 |
| 2012/0060563 | A1 * | 3/2012 | Henssen | 66/174 |

FOREIGN PATENT DOCUMENTS

| | | |
|---|---|---|
| WO | WO 2008/046476 | 4/2008 |
| WO | WO 2010/089410 | 8/2010 |

OTHER PUBLICATIONS

Nakajima et al., "Advanced Fiber Spinning Technology", *Society of Fiber Science & Technology*, 1994, 21 pages.

International Search Report for PCT/EP2012/058652, mailed Jun. 12, 2012.

* cited by examiner

*Primary Examiner* — Shaun R Hurley

(74) *Attorney, Agent, or Firm* — Nixon & Vanderhye P.C.

(57) ABSTRACT

There is provided a cut resistant yarn comprising a blend of first and second staple fibers, wherein, the first staple fibers are polymer-fibers, each first staple fiber comprising a polymer body encasing a hard component, said hard component being a plurality of hard fibers, said hard fibers having an average diameter of at most 25 microns; and the second staple fibers are different to the first staple fibers, wherein the weight ratio of the first to second staple polymer-fibers is from 1:99 to 99:1.

22 Claims, 1 Drawing Sheet

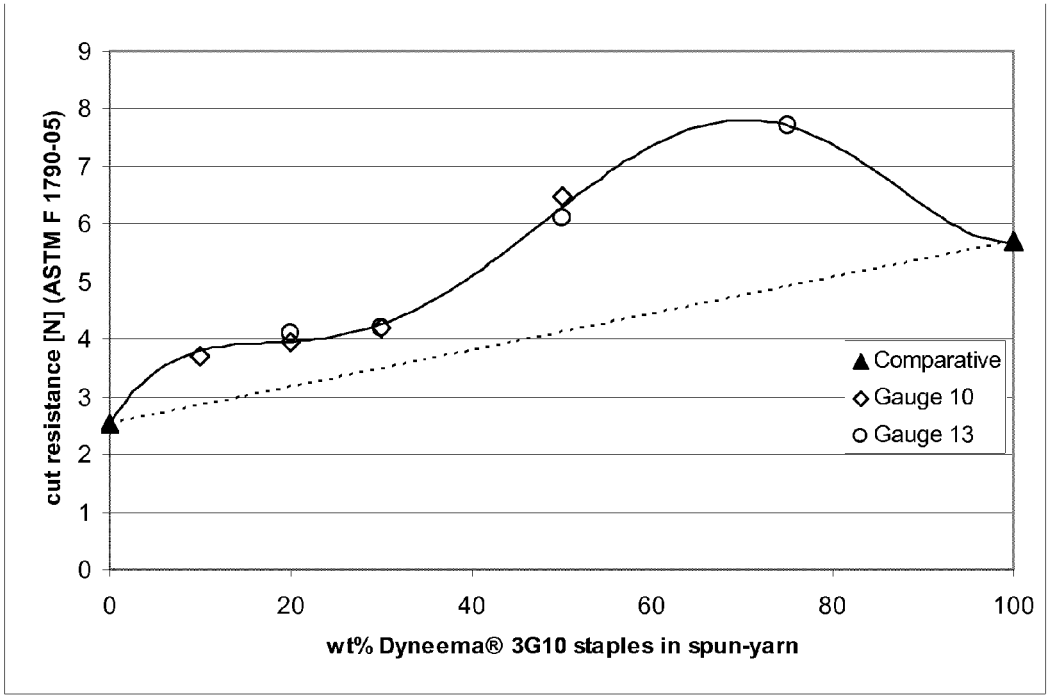
cut resistance [N] (ASTM F 1790-05)
9
8
7
6
5
4
3
2
1
0
0
20
40
60
80
100
wt% Dyneema® 3G10 staples in spun-yarn
Comparative
Gauge 10
Gauge 13

YARN, A PROCESS FOR MAKING THE YARN, AND PRODUCTS CONTAINING THE YARN

This application is the U.S. national phase of International Application No. PCT/EP2012/058652 filed 10 May 2012 which designated the U.S. and claims priority to EP 11165382.0 filed 10 May 2011, the entire contents of each of which are hereby incorporated by reference.

BACKGROUND OF THE INVENTION

1. Field of the Invention

The invention relates generally to a cut resistant yarn comprising staple fibers, a process for making the yarn, products comprising the yarn, and a process for making the products.

2. Description of the Related Art

Cut resistant products, such as garments, comprising cut resistant yarns are known. When in the form of garments such products are typically intended to protect a wearer from being cut, and may be used by persons working in for example the meat industry, the metal industry and the wood industry. Cut resistance can be usefully applied to all types of garments, especially those used as workwear and/or sportswear garments. Examples of garments that can be usefully adapted to be cut resistant include gloves, aprons, shirts, vests, jackets, trousers, cuffs, sleeves, overalls, sportsuits such as iceskating or cycling suits etc.

Cut resistant yarns are known and include yarns containing filaments of aramid, ultra high molecular weight polyethylene (UHMwPE) or polybenzoxazole. WO2008/046746, the content of which document is hereby incorporated by reference in its entirety, discloses a cut resistant yarn comprising a hard component in the form of a plurality of hard fibers having an average diameter of at most 25 micron. It is discussed therein that cut-resistant garments can be usefully made from the yarns.

Currently available cut resistant garments suffer the problem that they can be uncomfortable to wear, and more seriously can reduce freedom of movement, e.g. dexterity when wearing gloves, due to unacceptable weight and/or flexibility at desired cut resistance levels. It is very important that a garment have good wear comfort, since wearers may have to wear the garments for considerable periods of time while maintaining high levels of productivity. If a garment is not comfortable then wearers tend to suffer fatigue and may even refrain from donning such a protective garment, thus leading to higher accident risks.

WO2010/089410 discusses a cut resistant composite yarn and products, e.g. garments, comprising such a yarn. An embodiment of the composite yarn comprises an elastic filament wrapped in a cut resistant yarn to form a sheath around the elastic filament.

Although such yarns and products offer excellent wearer comfort and freedom of movement, it remains desirable to provide further yarns and garments that offer adequate cut resistance while showing good comfort levels.

BRIEF SUMMARY OF THE INVENTION

According to the present invention there is provided a yarn comprising a blend of at least first and second staple fibers, wherein:

a) the first staple fibers are polymer-fibers, each first staple fiber comprising a polymer body encasing a hard component, said hard component being a plurality of hard fibers, said hard fibers having an average diameter of at most 25 microns; and b) the second staple fibers are different to the first staple fibers, wherein, the weight ratio of the first to second staple fibers is from 1:99 to 99:1, preferably 1:99 to 45:55, more preferably from 10:90 to 35:65, most preferably 20:80 to 25:75.

According to a preferred embodiment of the invention there is provided a yarn spun from a blend of at least first and second staple fibers, wherein:

a) the first staple fibers are polymer-fibers, each first staple fiber comprising a polymer body encasing a hard component, said hard component being a plurality of hard fibers, said hard fibers having an average diameter of at most 25 microns; and b) the second staple fibers are different to the first staple fibers, wherein, the weight ratio of the first to second staple fibers in the blend is from 1:99 to 45:55, preferably from 10:90 to 35:65, most preferably 20:80 to 25:75. As a result of this preferred embodiment, the cut resistance of a fabric comprising such yarn shows a synergistic effect above the cut resistance of a fabric comprising a yarn with only the second staple fibers (i.e. 0:100).

According to another preferred embodiment of the invention, the weight ratio of the first to second staple fiber is from 46:54 to 99:1, preferably from 47:53 to 95:5, more preferably from 48:52 to 85:15, most preferably from 49:51 to 82:18. As a result of this preferred embodiment, the cut resistance of a fabric comprising such yarn is improved over the cut resistance of a fabric comprising a yarn comprising only the first staple fibers (i.e. 100:0) or comprising the first and the second staple fiber in a ratio outside the preferred ratio.

Suitable polymer filaments that can be divided into staple fibers for use as the first staple fibers of the present invention are described in international patent application WO2008/046476, the contents of which is hereby incorporated by reference in its entirety.

Various polymers are useful as the polymer of the first staple fibers. In general all synthetic polymers that are used for the production of staple fibers for use in yarn are considered to be useful.

Particular examples include polymers that are processed into a yarn as a melt and are then reduced in dimension to staple fibers, for example nylon and thermoplastic polyester. Preferably, however, polymers that are processed into yarns as a solution are used.

Most preferably polymers are used that exhibit high levels of cut resistance in the staple fibers in which they are incorporated. Examples of such polymers include aramid, UHMwPE (ultra high molecular weight polyethylene) and polybenzoxazol. Of these polymers UHMwPE is preferred, most preferably gel spun UHMwPE.

Gel-spinning of UHMwPE is described in EP 0205960 A, EP 0213208 A1, U.S. Pat. No. 4,413,110, GB 2042414 A, EP 0200547 B1, EP 0472114 B1, WO 01/73173 A1, and Advanced Fiber Spinning Technology, Ed. T. Nakajima, Woodhead Publ. Ltd (1994), ISBN 1-855-73182-7, and references cited therein. Gel spinning is understood to include at least the steps of spinning at least one filament from a solution of ultra-high molecular weight polyethylene in a spin solvent; cooling the filament obtained to form a gel filament; removing at least partly the spin solvent from the gel filament; and drawing the filament in at least one drawing step, to provide a gel spun filament. The filament can be divided by cutting or stretch breaking into a number of lengths of staple fiber.

Preferably the UHMwPE used to produce the first staple fibers has an intrinsic viscosity (IV) of at least 8 dl/g, as determined according to method PTC-179 (Hercules Inc.

Rev. Apr. 29, 1982) at 135 Degrees C. in decalin, with dissolution time of 16 hours, with anti-oxidant DBPC in an amount of 2 g/l solution, and the viscosity at different concentrations extrapolated to zero concentration.

The hard component fibers contained in the first staple fibers are embedded within the polymer body of each of the first staple fibers. In this way the hard component fibers make up part of the bulk of each the larger first staple fibers. It is possible to consider each first staple fiber as a matrix of polymer containing the hard component fibers.

The hard components preferably have an average diameter of at most 20 microns, more preferably at most 15 microns, most preferably at most 10 microns. For yarns with a smaller diameter comprising staple fibers with smaller diameters, preference is given to hard fibers having smaller diameters. Preferably at least a portion of the hard fibers have an average aspect ratio of at least 3, more preferably at least 6, even more preferably at least 10.

The aspect ratio of a hard fiber is the ratio between the average length and the average diameter of the hard fiber.

By average diameter is herein understood the numerical average diameter of the fibers and is calculated by the formula 1:

$$\bar{d} = \frac{1}{n}\sum_{i=1}^{n} d_i \qquad \text{Formula 1}$$

wherein n is the total number of fibers used to compute the average diameter; usually n=100 randomly picked fibers and $d_i$ is the diameter of the $i^{th}$ fiber.

By average length is herein understood the weighted average of the length of the fibers and is calculated by the formula 2:

$$\bar{l} = \sum_{i=1}^{n} w_i l_i \qquad \text{Formula 2}$$

in which w is the normalized weight fraction, and l is length, $l_i$ is length of weight fraction and $$\sum_{i=1}^{n} w_i = 1 \qquad \text{Formula 3}$$

The diameter and the aspect ratio of the cut-resistant component may easily be determined by using SEM pictures. For the diameter it is possible to make a SEM picture of the cut-resistant component as such, spread out over a surface and measuring the diameter at 100 randomly selected positions and then calculating the average of the so obtained 100 values. To calculate the aspect ratio, the length of hard fibers is measured in the same manner as the diameter thereof. Preferably the SEM pictures are made with backscattered electrons, providing a better contrast between the hard fibers and surface onto which they are spread.

The hard fibers comprise or consist of a hard material. Hard in the context of the invention means at least harder than the first staple fibers if not provided with the hard fibers. Preferably the hard material of the hard fibers has a Moh's hardness of at least 2.5, more preferably at least 4, most preferably at least 6. Examples of suitable hard fibers include, glass fibers, mineral fibers or metal fibers.

It is preferred that the hard fibers are spun fibers. An advantage of spun fibers is the consistency of their diameter, which if not entirely constant is typically at least within a limited range. As a result of this, a good consistency in the hard fiber properties is obtained, for example the mechanical properties exhibited in the staple fibers and the yarn. Particularly preferred hard fibers for use in the invention include rotation spun glass or mineral hard fibers.

An alternative preferred hard fiber is carbon fiber. Carbon fibers for use in the invention most preferably have a diameter of from 3 to 10 microns, more preferably from 4 to 6 microns. One advantage of using carbon fibers is an improved electrical conductivity, enabling the discharge of static electricity.

The first staple fibers can contain from 0.1 to 20 volume percent of the hard fibers, preferably from 1 to 10 volume percent, even more preferably contain from 2 to 7 vol. percent, and most preferably contain from 5 to 6 vol. percent.

The filaments from which the first staple fibers can be made, can be made by processes described in international patent application WO2008/046476. One process includes: a) mixing polymer powder or polymer granules and a plurality of hard fibers, b) melting or, more preferably, dissolving the polymer, while still mixing the polymer and the plurality of hard fibers c) respectively melt- or solution-spinning a yarn from the mixture obtained in step b). To form staple fibers there is provided an additional step d) of dividing (e.g. by stretch breaking or cutting) the filament into staple fibers.

An alternative process comprises the steps of: a) melting or dissolving a polymer, b) mixing the plurality of hard fibers with the molten polymer or the polymer solution, c) spinning a yarn from the mixture obtained in step b). To form staple fibers there is provided an additional step d) of dividing (e.g. by stretch breaking or cutting) the filament into staple fibers In a preferred embodiment of the invention the first staple fibers of the yarn are ultrahigh molecular weight polyethylene staple fibers, preferably gel spun ultrahigh molecular weight polyethylene, comprising a hard component, said hard component being a plurality of hard fibers, said hard fibers having an average diameter of at most 25 microns. Such fibers offer excellent cut resistance.

Processes for producing UHMwPE, hard component containing filaments are discussed in international patent application No. WO2008/046476. These filament can be made into staple fibers by dividing, e.g. by cutting, the filament into staple fibers.

One example process includes a gel spinning process for UHMwPE comprising the steps of: a) mixing UHMwPE powder and a plurality of hard fibers b) dissolving the UHMwPE into the solvent to obtain a slurry of the hard fibers in a solution of UHMwPE, c) spinning the slurry into a yarn according to the gel spinning process. To form staple fibers there is provided an additional step d) of dividing the filament into staple fibers.

Another example gel spinning process comprises the steps of: a) dissolving UHMwPE powder into a solvent, b) mixing the plurality of hard fibers with the solution obtained in step b), to obtain a slurry of the hard fibers in a solution of UHMwPE, c) spinning the slurry into a yarn according to the gel spinning process. To form staple fibers there is provided an additional step d) of dividing the filament into staple fibers.

The second staple fibers preferably have lower cut-resistance and/or lower strength than the first staple fibers, compared on the basis of the strength and/or cut-resistance values of a yarn consisting of first staple fibers and a yarn consisting of second staple fibers. The relative cut resistance of two yarns can be compared by constructing two fabrics identical in all respects except for the staple fibers from which the staple fibers consist, followed by testing of the cut resistance of the fabric by e.g. ASTM F1790/05.

Various fibers are useful as the second staple fibers. In general all polymer fibers are useful, both natural (e.g. cellulosic) and synthetic, that are used in the production of staple fibers for use in yarn. The second staple fibers may comprise or consist of the synthetic polymers described above in relation to the first staple polymer-fiber, but more preferably are fibers of polyamide (nylon), polyester (e.g. polyethylene terephthalate), meta/para-aramid, polyurethane, polyvinyl (e.g. halogen substituted polyvinyl, PVC, PTFE; acrylics, polyacrylonitrile; polyalcohols; vinyl acetate;), or polyalkylene. In addition to man-made fibers the second staple fibers may be natural fibers, for example, animal fibers such as silk or wool, or vegetable fibers such as cotton, linen, flax, hemp, ramie, and jute.

It is possible that the second fibers contain additives for example, anti-oxidants, thermal stabilizers, and colorants such as dyes or pigments.

It is preferred in the present invention that the second staple fibers are substantially free of UHMwPE. That is, they contain less than 3 wt. % of UHMwPE, more preferably less than 1 wt. %, and most preferably less than 0.1 wt %, based on total weight of the second stable polymer-fiber. More preferably the second staple polymer-fibers comprise a limited amount of polyethylene and can be substantially free of polyethylene. That is, they contain less than 40 wt. % of polyethylene, more preferably less than 30 wt. %, more preferably less than 5 wt %, and most preferably less than 3 wt %, based on total weight of the second stable polymer-fiber.

In a preferred embodiment of the present invention the second staple polymer-fibers are substantially free of hard components. That is, components that are harder than the second staple polymer-fibers if not provided with the components. Preferably the second staple polymer-fibers comprise less than 3 wt. % of hard components, more preferably less than 1 wt. %, and most preferably less than 0.1 wt %, based on total weight of the second stable polymer-fiber.

The yarn may consist of the first and second staple fibers, or may comprise additional components, such as one or more additional staple fibers different to the first and second staple fibers.

The term "staple fiber" is well known in the art of yarns and is generally understood to refer to fiber pieces divided (e.g. by cutting or breaking) from filament material. Staple fibers have a length that allows them to be blended with other fibers to form a blend-yarn. Staple fibers typically have lengths corresponding to the staple of cotton or wool. Preferably the staple fibers of the present invention have a length of up to about 1000 mm, more preferably of at least about 30 mm, more preferably of about 30 mm to 250 mm, more preferably from about 30 mm to about 130 mm, more preferably a length of from about 35 mm to about 100 mm, and most preferably from about 35 mm to about 70 mm.

The first staple fibers and the second staple fibers can be combined into blend-yarns according to the present invention by applying standard short staple or long staple spinning techniques (as appropriate) to mixtures of the staple fibers.

The yarn of the invention preferably has a titer of between 100 and 10,000 dtex.

Preferably the yarn of the invention has dimensions such that it is processable on a knitting machine of a gauge of at least 7, preferably at least 10, preferably at least 13, more preferably at least 15.

The invention further relates to fabrics comprising the blend-yarn of the invention. These can be made by knitting, weaving or by other methods, using conventional equipment, by which the yarn is formed into, or is incorporated into, a fabric. Fabrics comprising the yarn according to the invention may advantageously provide cut resistance. Preferably the fabrics have a cut resistance of at least 200 g, more preferably of at least 400 g and most preferably at least 500 g, as measured by ASTM F1790/05.

Preferred fabrics, especially for gloves, have an areal density of at most 700 g/m$^2$, more preferably at most 600 g/m$^2$ and most preferably at most 400 g/m$^2$.

Yarns and fabrics according to the invention can be applied in all kinds of products, for example, garments intended to protect persons from being cut, the persons working in the meat industry, the metal industry and the wood industry. Examples of such garments include gloves, aprons, trousers, cuffs, sleeves, etc. Other possible applications include side curtains and tarpaulins for trucks, soft sided luggage, commercial upholstery, airline cargo container curtains, fire hose sheathes etc.

Such products can be manufactured by known processes, for example by circular or warp knitting, weaving, or braiding of the yarn into for example a garment or by stitching together fabric pieces

EXAMPLES

The following is a description of a number of example gloves and comparative gloves provided for the purpose of non-limiting illustration of the invention.

The example gloves were flat knitted on a 10 gauge or a 13 gauge glove knitting machine from SHIMA SEIKI Mfg., Ltd. of Japan.

Each of the example gloves 1 to 8 was knitted from a single end of blended spun-yarn having a count of Nm28/2 and a single end of continuous filament polyamide yarn having a count of 78 dtex. The blended spun-yarns used in each of the examples were short staple spun-yarns spun from a blend of Dyneema® 3G10 filament (available as continuous filament yarn from DSM Dyneema® of the Netherlands) cut by rolling blade into a 48 mm staple fiber as first staple fiber, and 48 mm staple standard nylon fiber as second staple fiber. The weight ratio of the first to second staple fiber was varied for each of the glove samples 1 to 8 as indicated in table 1 below.

Comparative gloves C-1 and C-2 were knitted on a gauge 13 machine as described for the example gloves above whereby for the Comparative Glove C-1, the single end of blended spun-yarn was substituted by spun-yarn spun from the 48 mm Dyneema® 3G10 staples only and whereby for the Comparative Glove C-2, the single end of blended spun yarn was substituted by a spun-yarn spun from the 48 mm standard nylon staple fibers only.

The cut resistance of each of the example gloves and comparative gloves was measured in accordance with ASTM F 1790-05 using cut tester CPPT. The results of the measurements are reported in table 1. As can be seen from the reported values, the example gloves show good cut resistance. It was also observed that the gloves showed good levels of wearer comfort.

FIG. 1 represents a plot of the cut resistance results of the example gloves and the comparative gloves. The x-axis represents the amount of the 48 mm Dyneema® 3G10 staples in wt % present in the blended spun-yarn and the y-axis represents the cut resistance of the gloves according to above mentioned measurement. The dotted line represents the expected cut resistance of a glove made with blended spun-yarns, based on the cut resistances of the comparative gloves with Dyneema® 3G10 and nylon spun-yarns, respectively. In the range of 1-45 wt % of staple Dyneema® 3G10, the plot shows the advantage of using low amounts of the first staple fibers in yarns according to the invention over gloves without said first staple fibers.

Further does FIG. 1 show the advantage of further increasing the amounts of a first staple fiber in yarns according to the invention, i.e. above a 46:54 ratio, by a synergistic effect of the first and the second staple fiber. The blended spun-yarns in this range comprising amounts of second staple fibers according to the invention prove to be superior to spun-yarns only comprising the first staple fibers.

TABLE 1

| Glove Sample No. | Blended Spun-Yarn composition Weight ratio of first staple fiber:second staple fiber | Areal Density (gr/m$^2$) | Gauge | Cut-Resistance (N) |
|---|---|---|---|---|
| 1 | 50:50 | 280 | 10 | 6.48 |
| 2 | 30:70 | 265 | 10 | 4.22 |
| 3 | 20:80 | 265 | 10 | 3.96 |
| 4 | 10:90 | 265 | 10 | 3.71 |
| 5 | 75:25 | 265 | 13 | 7.72 |
| 6 | 50:50 | 265 | 13 | 6.12 |
| 7 | 30:70 | 290 | 13 | 4.22 |
| 8 | 20:80 | 290 | 13 | 4.12 |
| Comp. 1 | 100:0 (only Dyneema ® 3G10 staples) | 245 | 13 | 5.69 |
| Comp. 2 | 0:100 (only Nylon staples) | 265 | 13 | 2.53 |

Further modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A cut resistant yarn comprising a blend, wherein the blend consists of first and second staple fibers, wherein:

a) the first staple fibers are polymer-fibers, each first staple fiber comprising a polymer body encasing a hard component, said hard component being a plurality of hard fibers, said hard fibers having an average diameter of at most 25 microns; and b) the second staple fibers are different than the first staple fibers, and wherein the first to second staple fibers are present in the blend in a weight ratio from 1:99 to 99:1.

2. The yarn of claim 1, wherein the weight ratio of the first to second staple fibers is from 99:1 to 45:55.

3. The yarn of claim 1, wherein the weight ratio of the first to second staple fibers is from 46:54 to 1:99.

4. The yarn of claim 1, wherein the first staple fibers are staple fibers of ultrahigh molecular weight polyethylene, staple fibers of polyamide, or staple fibers of polyester.

5. The yarn of claim 1, wherein the second staple fibers are staple fibers of polyamide, polyester, acrylic, polypropylene, para-aramid, meta-aramid, wool, cotton, polyurethane, polyvinyl, polyalkylene, silk, wool, cellulose, linen, flax, hemp, ramie, or jute.

6. The yarn of claim 1, wherein the first fibers are staple fibers of ultrahigh molecular weight polyethylene, and the second staple fibers are substantially free of ultrahigh molecular weight polyethylene.

7. The yarn of claim 1, having a titer of between 100 and 10,000 dtex.

8. The yarn of claim 1, wherein said the yarn is processable on a knitting machine of 7 or higher gauge.

9. The yarn of claim 1, wherein the weight ratio of the first to second staple fibers is from 10:90 to 35:65.

10. The yarn of claim 1, wherein the weight ratio of the first to second staple fibers is from 20:80 to 25:75.

11. The yarn of claim 1, wherein the weight ratio of the first to second staple fibers is from 47:53 to 95:5.

12. The yarn of claim 1, wherein the weight ratio of the first to second staple fibers is from 48:52 to 85:15.

13. The yarn of claim 1, wherein the weight ratio of the first to second staple fibers is from 49:51 to 82:18.

14. A fabric comprising the yarn of claim 1.

15. A method of making a cut resistant fabric comprising a step of knitting, braiding, or weaving a cut-resistant yarn to form the cut-resistant fabric, wherein the cut-resistant yarn consists of a blend of first and second staple fibers at a weight ratio of the first staple fibers to the second staple fibers from 1:99 to 99:1, wherein the first staple fibers are polymer-fibers, each first staple fiber comprising a polymer body encasing a hard component, said hard component being a plurality of hard fibers, said hard fibers having an average diameter of at most 25 microns, and wherein the second staple fibers are different than the first staple fibers.

16. A fabric obtained by the method of claim 15.

17. The fabric according to claim 14, having a cut resistance above 500 g and an areal density of at most 400 g/m2.

18. A cut-resistant product comprising the yarn of claim 1.

19. The cut-resistant product of claim 18, wherein the product is a garment.

20. The cut-resistant product of claim 19, wherein the garment is a glove, an apron, a shirt, a vest, a jacket, trousers, a cuff or a sleeve.

21. A method of manufacturing a cut-resistant garment comprising a step of knitting a cut-resistant yarn to form the cut-resistant garment, wherein the cut-resistant yarn consists of a blend of first and second staple fibers at a weight ratio of the first staple fibers to the second staple fibers from 1:99 to 99:1, wherein the first staple fibers are polymer-fibers, each first staple fiber comprising a polymer body encasing a hard component, said hard component being a plurality of hard fibers, said hard fibers having an average diameter of at most 25 microns, and wherein the second staple fibers are different than the first staple fibers.

22. A method of manufacturing a garment comprising:

(i) providing a cut-resistant fabric which is comprised of a cut resistant yarn consisting of a blend of first and second staple fibers at a weight ratio of the first staple fibers to the second staple fibers from 1:99 to 99:1, wherein the first staple fibers are polymer-fibers, each first staple fiber comprising a polymer body encasing a hard component, said hard component being a plurality of hard fibers, said hard fibers having an average diameter of at most 25 microns, and wherein the second staple fibers are different than the first staple fibers; and (ii) stitching the cut-resistant fabric into a garment.

* * * * *